United States Patent [19]

Horita

[11] Patent Number: 4,660,258

[45] Date of Patent: Apr. 28, 1987

[54] SEPARABLE SLIDE FASTENER

[75] Inventor: Yoshiyuki Horita, Toyama, Japan

[73] Assignee: Yoshida Kogyo K. K., Tokyo, Japan

[21] Appl. No.: 741,142

[22] Filed: Jun. 4, 1985

[30] Foreign Application Priority Data

Jun. 5, 1984 [JP] Japan ..... 59-83386

[51] Int. Cl.[4] ..... A44B 19/38

[52] U.S. Cl. ..... 24/433; 24/434

[58] Field of Search ..... 24/433, 434

[56] References Cited

U.S. PATENT DOCUMENTS

| | | | |
|---|---|---|---|
| 2,146,691 | 2/1939 | Sundback | 24/433 |
| 2,577,855 | 12/1951 | Moehler | 24/433 |
| 2,583,386 | 1/1952 | Moehler | 24/433 |
| 4,112,553 | 9/1978 | Weitzner | 24/433 X |
| 4,505,009 | 3/1985 | Yoshida et al. | 24/433 |
| 4,536,923 | 8/1985 | Murakami | 24/433 |

FOREIGN PATENT DOCUMENTS

| | | | |
|---|---|---|---|
| 48009 | 9/1980 | German Democratic Rep. | 24/433 |
| 891665 | 3/1962 | United Kingdom | 24/433 |

*Primary Examiner*—Peter A. Aschenbrenner

*Attorney, Agent, or Firm*—Hill, Van Santen, Steadman & Simpson

[57] ABSTRACT

In a separable bottom-end-stop assembly of a separable slide fastener, a socket member secured to one of a pair of pin members has a single pawl or claw projecting inwardly from a rear wall of the socket member through a rear wall of the one pin member into a stringer tape. The socket member also has a first drawn protuberance projecting inwardly from the rear wall thereof into the rear wall of the one pin member, while the one pin member has, in underlying relation to the first drawn protuberance, a second drawn protuberance projecting inwardly from the rear wall of the one pin member to squeeze the stringer.

3 Claims, 5 Drawing Figures

SEPARABLE SLIDE FASTENER

BACKGROUND OF THE INVENTION

1. Field of the Invention

The present invention relates to a slide fastener, and more particularly to a separable slide fastener having a separable bottom-end-stop assembly.

2. Description of the Prior Art

There are known various separable slide fasteners in which a separable bottom-end-stop assembly of metal is mounted on adjacent bottom ends of opposed fastener stringers, the separable bottom-end-stop assembly comprising a pair of pin members secured to the inner tape-margins, and a socket member secured to one of the pin members. To this end, as disclosed in Japanese Utility Model Laid-Open Publication (Jikkaisho) 59-50312, it is known that the socket member has a pair of claws punched from a rear wall thereof and projecting inwardly through a rear wall of pawl or the one pin member into a stringer tape in order for non-rotatable attachment. However, this prior socket member tends to be cracked in portions not only between two openings (formed when punching the respective claws) but also between a bottom end of the socket member and one of the openings adjacent thereto, thus causing non-stable attachment of the socket member, which would sometimes result in removal of the socket member.

SUMMARY OF THE INVENTION

In a separable slide fastener according to the present invention, a socket member secured to one of a pair of pin members has a single pawl or claw projecting inwardly from a rear wall of the socket member through a rear wall of the one pin member into a stringer tape. The socket member also has a first drawn protuberance projecting inwardly from the rear wall thereof into the rear wall of the one pin member, while the one pin member has, in superimposed relation to the first protuberance, a second drawn protuberance projecting inwardly from the rear wall of the one pin member to squeeze the stringer tape.

It is therefore an object of the present invention to provide a separable slide fastener having an improved bottom-end-stop assembly in which a socket member is attached to one of a pair of pin members accurately and stably.

Another object of the invention is to provide a separable slide fastener having an improved bottom-end-stop assembly in which a socket member is free from cracks and hence cannot be easily displaced on or removed from one pin member while the slide fastener is in use.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
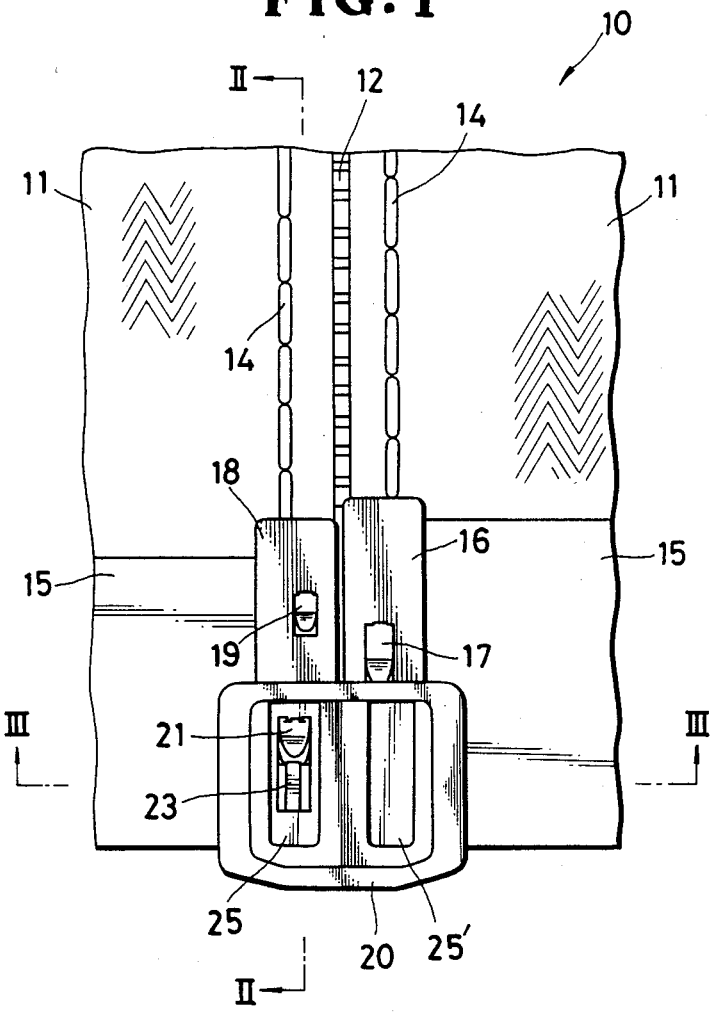
FIG. 1 is a fragmentary rear view of a separable slide fastener having a separable bottom-end-stop assembly embodying the present invention.

The principles of the present invention are particulary useful when embodied in a separable slide fastener such as shown in FIG. 1, generally indicated by the numeral 10.

The separable slide fastener 10 comprises a pair of fastener stringers each including a stringer tape 11 carrying on and along its inner longitudinal margin a row of fastener elements 12 attached to the tape 11 by sewn stitches 14, there being a core thread 13 (FIGS. 3 & 4) extending through and beyond the row of fastener elements 12. Each stringer has at its bottom end portion a pair of reinforcing strips 15 of thermoplastic synthetic resin attached to opposite surfaces of the stringer tape 11. A separable bottom-end-stop assembly is mounted on adjacent bottom ends of the fastener stringers 11, 11 at the respective bottom end portions of the confronting inner tape-margins, which portions are devoid of fastener elements 12. A slider (not shown) is threaded on the opposed rows of fastener elements 12, 12 for movement therealong to close and open the slide fastener 10.

As shown in FIGS. 1–4, the separable bottom-end-stop assembly includes a first separate pin member 18 secured to the bottom end portion of one of the confronting inner tape-margins, a second separate pin member 16 of metal secured to the bottom end portion of the other inner tape-margin, and a socket member 20 of metal secured to the first pin member 18.

The socket member 20 has a first bore **20*a* (FIGS. 2 and 3) receiving a portion of the first pin member 18 in a fitting manner and a second bore 20*b* (FIG. 3) for receiving a portion of the second pin member 16**.

The first pin member 18 has a pair of longitudinally spaced first pawls or claws 19, 22 each projecting inwardly from its rear wall through the reinforcing strip 15 into the stringer tape 11, while the second pin member 16 has a single second pawl or claw 17 projecting substantially centrally and inwardly from its rear wall through the reinforcing strip 15 into the corresponding stringer tape 11. The second pawls or claws 17 and one of the first pawl or claw 19 are formed by punching when the corresponding pin members 16, 18 are attached to the respective stringer tapes 11, 11; the other first pawl or claw 22, (FIG. 2) is formed in a manner described below.

The socket member 20 has in its rear wall a pair of laterally spaced small-thickness portions 25, 25' for a purpose described below. From one of the small-thickness portions 25, a single third pawl or claw 21 projects inwardly through the rear wall of the first pin member 18 into the stringer tape 11 in such a manner that the third pawl or claw 21 and the other first pawl or claw 22 are disposed in a superimposed relationship. Further, a first drawn protuberance 23 (FIGS. 1–3) is disposed near the third pawl or claw 21 and bulges or projects inwardly from the one small-thickness portion 25 of the rear wall of the socket member 20 into the rear wall of the first pin member 18, i.e. toward the stringer tape 11. The first pin member 18 has, in superimposed relation to the first drawn protuberance 23, an inwardly projecting drawn second protuberance 24 (FIGS. 2 and 3) which bulges to squeeze the reinforcing strip 15 and the stringer tape 11.

For assembly, the first pin member 18 (initially without a pawl or claw) is threaded onto the element-free bottom end portion of the inner tape-margin of one of the stringers, and is then struck on the rear wall with a non-illustrated punch in such a manner that the one first pawl or claw 19 is thereby formed in the rear wall and is then forced inwardly to project into the stringer tape 11. Thus the first pin member 18 has been fixedly secured to the one stringer. Meanwhile, the second pin member 16 is also fixedly secured to the other stringer in the same manner as the first pin member 18.

Figure 2:
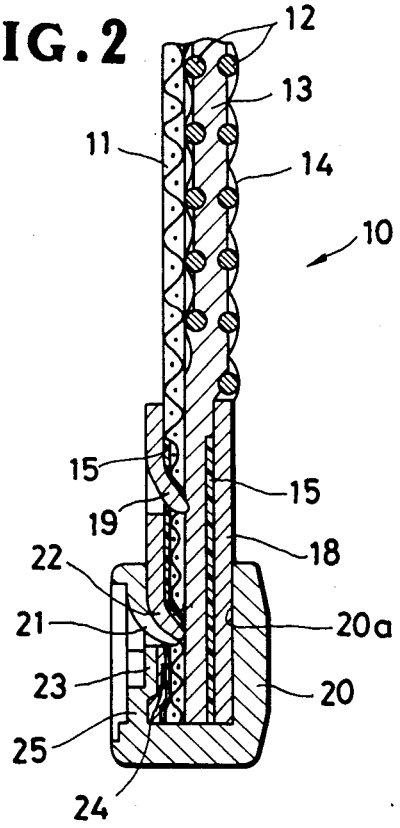
FIG. 2 is a longitudinal cross-sectional view taken along line II—II of FIG. 1.
Figure 5:
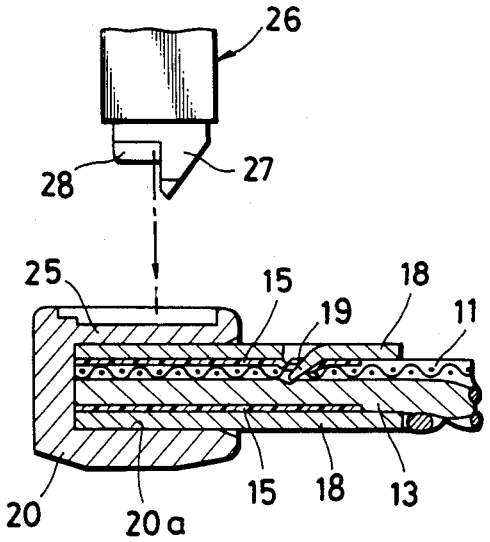
FIG. 5 illustrates the manner in which a socket member is attached to one of a pair of pin members by means of a punch.

Subsequently, an end portion of the first pin member 18 is inserted in the first bore 20*a* of the socket member 20 as shown in FIG. 5, and the rear wall of the socket member 20 is struck on one of the small-thickness portions 25 with a punch 26 which has first and second punching portions 27, 28. At that time, the first punching portion 27 of the punch 26 pierces the rear wall of the socket member 20 and the rear wall of the first pin member 18 to provide the third pawl or claw 21 and the other first pawl or claw 22 therein respectively and then to force these two pawls or claws 21, 22 inwardly in a superimposed relationship. As a result, as best shown in FIG. 2, the third pawl or claw 21 projects inwardly from the small-thickness portion 25 of the rear wall of the socket member 20 through the rear wall of the first pin member 18 and through the reinforcing strip 15 into the stringer tape 11, while the other first pawl or claw 22 projects inwardly from the rear wall of the first pin member 18 through the reinforcing strip 15 into the stringer tape 11.

Figure 3:
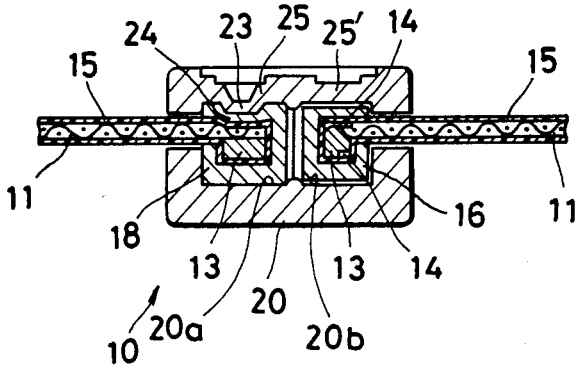
FIG. 3 is a transverse cross-sectional view taken along line III—III of FIG. 1.
Figure 4:
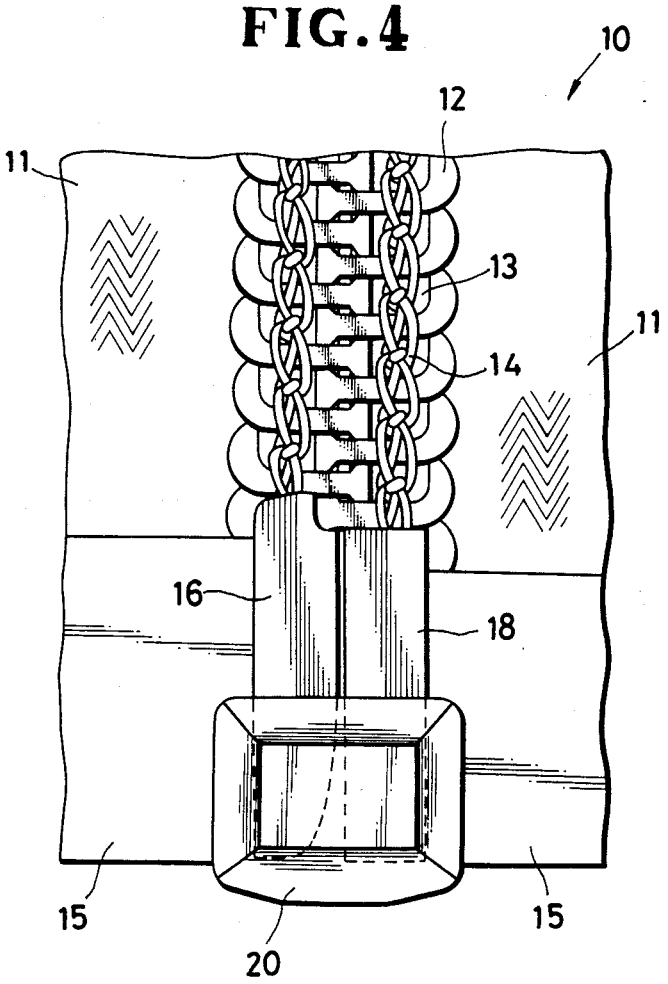
FIG. 4 is a fragmentary front view of the structure of FIG. 1.

Meanwhile, the second punching portion 28 acts on an adjacent portion 25 of the rear wall of the socket member 20, and thus the rear wall of the first pin member 18, to provide by drawing the first and second drawn protuberances 23, 24 respectively thereon in a superimposed relationship. As a result, as best shown in FIGS. 2 and 3, the first drawn protuberance 23 bulges inwardly from the small-thickness portion 25 of the rear wall of the socket member 20 into the rear wall of the first pin member 18, while the second drawn protuberance 24 bulges inwardly from the rear wall of the first pin member 18 to force the stringer tape 11, together with the pair of reinforcing strips 15 and the core thread 13, against a front wall of the first pin member 18 and thus a front wall of the socket member 20.

With this arrangement, the socket member 20 can be non-rotatably attached to the first pin member 18 accurately with adequate firmness, partly because the socket member 20 and the first pin member 18 are joined together at two different points spaced apart from each other longitudinally along the first pin member 18.

Further, since there is only a single pawl or claw in its rear wall, the socket member 20 is free from being cracked while the slide fastener 10 is in use.

The purpose of the small-thickenss portion 25 of the socket member 20 is to facilitate the forming of the third pawl or claw 21 and the first drawn protuberance 23.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A separable slide fastener, comprising:

(a) a pair of fastener stringers each having a stringer tape carrying a row of fastener elements;

(b) a slider movable along said pair of stringers to open and close the slide fastener; and (c) a separable bottom-end-stop assembly mounted on adjacent ends of said stringers and including (1) a first pin member secured to one of said stringers and having a first rear wall normally obscured in use, (2) a second pin member secured to the other of said stringers, and (3) a socket member disposed on said first pin member and having a first bore receiving a portion of said first pin member and a second bore for removably receiving a portion of said second pin member, said socket member having a single tooth projecting inwardly from a second rear wall normally obscured in use on said socket member through said first rear wall of said first pin member into said stringer tape of said one stringer, said socket member having near said tooth a first drawn protuberance projecting inwardly from said second rear wall into said first rear wall of said first pin member, said first pin member having, in underlying relation to said first drawn protuberance, a second drawn protuberance projecting inwardly from said first rear wall and squeezing said stringer tape of said one stringer.

2. A separable slide fastener according to claim 1, said second rear wall of said socket member having a small-thickness portion from whcih said tooth is punched and from which said first protuberance is drawn.

3. A separable slide fastener, comprising:

(a) a pair of fastener stringers each having a stringer tape carrying a row of fastener elements; each of said stringers having at an end thereof a pair of reinforcing strips of thermoplastic synthetic resin attached to opposite surfaces of said stringer tape;

(b) a slider movable along said pair of stringers to open and close the slide fastener; and (c) a separable bottom-end-stop assembly mounted on adjacent ends of said stringers and including (1) a first pin member secured to one of said stringers and having a first rear wall normally obscured in use, (2) a second pin member secured to the other of said stringers, and (3) a socket member disposed on said first pin member and having a first bore receiving a portion of said first pin member and a second bore for removably receiving a portion of said second pin member, said socket member having a single tooth projecting inwardly from a second rear wall normally obscured in use on said socket member through said first rear wall of said first pin member, through one of said reinforcing strips and into said stringer tape of said one stringer, said socket member having near said tooth a first drawn protuberance projecting inwardly from said second rear wall into said first rear wall of said first pin member, said first pin member having, in underlying relation to said first drawn protuberance, a second drawn protuberance projecting inwardly from said first rear wall and disposed against said one reinforcing strip and squeezing said stringer tape of said one stringer.

* * * * *